US008267662B2

(12) United States Patent
Patrick et al.

(10) Patent No.: US 8,267,662 B2
(45) Date of Patent: Sep. 18, 2012

(54) MONOLITHIC AND BI-METALLIC TURBINE BLADE DAMPERS AND METHOD OF MANUFACTURE

(75) Inventors: D. Keith Patrick, Cincinnati, OH (US); Randall Charles Bauer, Loveland, OH (US); Thomas Joseph Kelly, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 1157 days.

(21) Appl. No.: 11/955,566

(22) Filed: Dec. 13, 2007

(65) Prior Publication Data

US 2010/0008778 A1 Jan. 14, 2010

(51) Int. Cl.
*F01D 5/10* (2006.01)

(52) U.S. Cl. ..... 416/146 R; 416/241 R; 416/500

(58) Field of Classification Search ..... 416/146 R, 416/241 R, 500; 428/668, 680
See application file for complete search history.

(56) References Cited

U.S. PATENT DOCUMENTS

| | | | | |
|---|---|---|---|---|
| 2,412,615 | A | 12/1946 | Howard | |
| 2,750,147 | A | 6/1956 | Smith | |
| 5,061,324 | A * | 10/1991 | Chang | 148/514 |
| 5,165,860 | A * | 11/1992 | Stoner et al. | 416/224 |
| 5,215,442 | A | 6/1993 | Steckle et al. | |
| 5,356,264 | A | 10/1994 | Watson et al. | |
| 5,369,882 | A | 12/1994 | Diet et al. | |
| 5,498,137 | A | 3/1996 | El-Aini et al. | |
| 6,224,341 | B1 | 5/2001 | Fricke | |
| 6,283,707 | B1 | 9/2001 | Chin | |
| 6,331,217 | B1 | 12/2001 | Burke et al. | |
| 6,428,637 | B1 * | 8/2002 | Wood et al. | 148/555 |
| 6,929,451 | B2 * | 8/2005 | Gregg et al. | 416/96 R |
| 6,939,508 | B2 | 9/2005 | Bampton et al. | |
| 6,958,084 | B2 * | 10/2005 | Whitaker et al. | 75/231 |
| 7,125,225 | B2 | 10/2006 | Surace et al. | |
| 7,270,517 | B2 * | 9/2007 | Garner | 416/145 |
| 7,300,256 | B2 * | 11/2007 | Masserey et al. | 416/230 |
| 7,736,124 | B2 * | 6/2010 | Bauer et al. | 415/119 |
| 7,824,158 | B2 * | 11/2010 | Bauer et al. | 416/232 |
| 2003/0202883 | A1 | 10/2003 | Davis et al. | |
| 2006/0024190 | A1 | 2/2006 | Kelly | |
| 2006/0280606 | A1 | 12/2006 | Busbey et al. | |

FOREIGN PATENT DOCUMENTS

| | | | |
|---|---|---|---|
| CA | 582411 | A | 9/1959 |
| EP | 1734229 | A2 | 12/2006 |
| EP | 2009240 | A2 | 12/2008 |
| GB | 2405186 | A | 2/2005 |

OTHER PUBLICATIONS

Search Report and Written Opinion from corresponding EP Application No. 08170599.8-2321 dated May 18, 2012.

* cited by examiner

*Primary Examiner* — Ninh H Nguyen
(74) *Attorney, Agent, or Firm* — McNees Wallace & Nurick LLC

(57) ABSTRACT

A method for manufacturing a turbine damper by a metal injection molding process is disclosed. The damper includes a base section and a wire section, and is formed of a nickel-base or cobalt base superalloy.

19 Claims, 3 Drawing Sheets

MONOLITHIC AND BI-METALLIC TURBINE BLADE DAMPERS AND METHOD OF MANUFACTURE

FIELD OF THE INVENTION

The present invention relates generally to gas turbine engines, and more specifically, to an improved mechanism for damping vibrations in turbine or compressor blades of gas turbine aircraft engines.

BACKGROUND OF THE INVENTION

In a gas turbine engine, air is pressurized in a compressor and mixed with fuel in a combustor for generating hot combustion gases. Energy is extracted from the combustion gases by passing the gases over turbine rotor blades that in turn power the compressor, and an upstream fan in an exemplary turbofan aircraft engine application.

Each rotor blade includes an airfoil extending radially outwardly from an inner platform, with the platform being joined by a shank to a supporting dovetail mounted in a corresponding slot in the perimeter in a supporting rotor disk. During operation, the blades drive the rotor at substantial speed and are subject to centrifugal forces or loads that pull the blades radially outwardly in their supporting slots in the perimeter of the rotor disk. The dovetail typically includes multiple lobes or tangs that carry the centrifugal loads of each blade into the rotor disk while limiting the stresses in the blade for ensuring long blade life.

Each rotor blade is subject to pressure, thermal loads and stresses from the combustion gases that flow over the blades during operation. The blades are also subject to vibratory stress due to the dynamic excitation thereof by the rotating blades and the pressure forces from the combustion gases. The blades are relatively thin to minimize weight and the resultant centrifugal loads, making the blades susceptible to vibratory excitation in various modes. For example, the airfoil may be subject to vibratory bending along the radial or longitudinal span thereof, as well as higher order bending modes along the axial chord direction.

Accordingly, turbine blades may include a vibration damper mounted under the blade platforms. The dampers are supported by the platform and dovetail and add centrifugal loads to the rotor disk. The dampers use friction with the excited platform to provide effective damping of the blade during operation at speed. However, these dampers have limited effectiveness for the various modes of vibration of the turbine blade during operation, including the higher order natural modes of airfoil vibration that involve complex combinations of airfoil bending in both the chord and span directions.

One approach to dampen vibration occurring in the airfoil has been to position dampers within the airfoil of the turbine blade. One approach includes a bipedal damper that includes a pair of wires or pins extending into the flow channels. However, the geometry of these dampers require complex forming processes that are expensive and do not provide for different material characteristics in different positions in the damper. For example, one may require a material with excellent wear resistance in one location where the material of the damper is in contact with the material of the component being dampened, yet also require a material of high strength in another location where the damper is subjected to the same high centrifugal loading seen by the rotor and attached turbine blade. In this case, a cast monolithic damper may be used but may provide less than optimum performance due to defects that can be introduced during the forming operation, sub-optimum wear characteristics that may cause wire failure due to frictional wear, or may rupture due to high tensile loading.

Another known damper design has taken the form of a wire or small diameter bar, measuring about 0.020 inches to about 0.200 inches in diameter and from about 2 inches to about 5 inches in length, that are inserted into a cavity of the turbine blade. These dampers are referred to as wire or stick dampers. The wire dampers are positioned within the airfoil and typically extend the length of the turbine blade. The dampers are in contact with supporting lands formed on the internal wall of the turbine blade. Frictional vibration between the damper and the airfoil dissipates excitation forces and effectively dampens blade vibration.

However, frictional dampening is subject to wear between the damper and the airfoil, and the damper is subject to substantial centrifugal loads during operation and experiences corresponding tensile stresses and bending stresses along its length.

In order to increase blade life, the damper should be formed of a material having sufficient high strength for affecting long low cycle fatigue life, long high cycle fatigue life, and long rupture life. These life factors are typically controlled by the highest steady state stress portions of the damper, which are typically in the supporting portion of the damper in the dovetail.

In contrast, the outer portion of the damper is subject to frictional vibration with the airfoil and experiences lower stresses during operation, but is subject to high frictional wear. Up to this time, blade vibration damper designs fail to strike a compromise between wear and strength performance of the damper.

Therefore, what is needed is a wire damper that provides dampening, is simple to produce, and is simple to include in the blade design. The wire damper should also provide improved wear resistance in combination with high strength.

SUMMARY OF THE INVENTION

Accordingly, it is an object of the present invention to provide a high strength wire damper that has improved wear resistance and a method of making the wire damper having such characteristics.

One embodiment of the invention includes a damper for a turbine blade having a wire section and a mounting block metallurgically bonded at a proximal end of the wire section. The wire section and the mounting block may be formed of substantially the same material. The damper material may be a nickel or cobalt based superalloy.

The nickel based superalloy may have, for example, a composition in approximate weight percent containing Co: 3.1-21.6%, Fe: 0-0.5%, Cr: 4.2-19.5%, Al: 1.4-7.80%, Ti: 0-5.00%, Ta: 0-7.20%, Nb 0-3.50%, W: 0-9.50%, Re 0-5.40%, Mo: 0-10.00%, C: 0.02-0.17, Hf: 0-1.55%, B: 0.004-0.030%, Zr: 0-0.09%, Y: 0-0.01%, Mn: 0-1.00%, Cu: 0-0.50%, Si: 0-0.55%, remainder Ni. For example, the nickel based superalloy may be selected from Rene® 77, Rene® 80, Rene® 108, Rene® 125, Rene® 142 or other nickel based alloy. RENE® is a trademark of Teledyne Industries, Inc., Los Angeles, Calif. for superalloy metals.

RENE® 77, RENE® 80, RENE® 108, RENE® 125 and RENE® 142 have the following nominal compositions in weight percent:

TABLE 1

| Alloy | Ni | Co | Fe | Cr | Al | W | Ti | Mo | C | B | Zr |
|---|---|---|---|---|---|---|---|---|---|---|---|
| Rene'® 80 | Balance | 9.5 | | 14 | 3 | 4 | 5 | 4 | 0.17 | 0.015 | 0.03 |
| Rene'® 77 | Balance | 15 | 0.5 | 14.6 | 4.3 | 0 | 3.35 | 4.2 | 0.07 | 0.015 | 0.04 |
| Rene'® 108 | Balance | 9.5 | — | 8.4 | 5.5 | 9.5 | 0.8 | 0.5 | 0.09 | 0.02 | |
| Rene'® 125 | Balance | 10 | — | 8.9 | 4.8 | 7 | 2.5 | 2 | 0.11 | 0.02 | 0.1 |
| Rene'® 142 | Balance | 12 | — | 6.8 | 6.15 | 4.9 | — | 1.5 | 0.12 | 0.02 | 0 |

The cobalt based superalloy may be selected from cobalt alloys having, for example, an approximate composition in weight percent containing Ni: 6.0-22.0%, Fe: 0-3.0%, Cr: 20.0-23.5%, Ti: 0-0.20%, Ta: 0-3.50%, W: 7.00-15.00%, C: 0.10-0.60, Zr: 0-0.50%, Mn: 0-1.50%, Si: 0-0.50%, remainder Co. The cobalt based superalloy may be selected from the group MAR-M-509 (MM509), L605, X40 and other cobalt based alloys.

MM509, L 605 and X 40 have the following nominal compositions in weight percent:

TABLE 2

| Alloy | Co | Ni | Cr | Fe | Ta | Ti | W | C | Zr | Mn | Si |
|---|---|---|---|---|---|---|---|---|---|---|---|
| L 605 | Balance | 10 | 20 | 3 | — | — | 15 | 0.1 | — | 1.5 | — |
| MM 509 | Balance | 10 | 24 | — | 3.5 | 0.2 | 7 | 0.6 | 0.5 | — | — |
| X 40 | Balance | 10 | 22 | 1.5 | — | — | 7.5 | 0.5 | — | 0.5 | 0.5 |

In another embodiment of the invention, the wire section and the mounting block of the damper are formed of substantially dissimilar materials. The wire section may be formed of a cobalt based superalloy. The cobalt based superalloy may be MAR-M-509. The mounting block may be formed of a nickel based superalloy. The nickel based superalloy may be Rene 80® or Rene 142®.

A further embodiment of the invention includes a method of forming a damper for a turbine blade including injection molding a first material into a die having a first die section configured to form a wire shape, providing a second material into a second die section of the die configured to provide a block shape at one distal end of the wire shape to form a green damper, heating the green damper to sinter the first materials and form a sintered brown damper, and heat treating the sintered brown damper to form a near net shape, high density damper. The heat treating may be performed by hot isostatic pressing.

In one embodiment of the method, the first material and the second material may be substantially the same materials, or alternatively, the first material and the second material may be dissimilar materials.

The second material may be provided by injection molding the second material into the second die section of the die. Alternatively, the second material may be provided by placing a preform in the second die section of the die. The first material may be a nickel based or cobalt based superalloy.

The nickel based superalloy may have, for example, a composition in approximate weight percent containing Co: 3.1-21.6%, Fe: 0-0.5%, Cr: 4.2-19.5%, Al: 1.4-7.80%, Ti: 0-5.00%, Ta: 0-7.20%, Nb 0-3.50%, W: 0-9.50%, Re 0-5.40%, Mo: 0-10.00%, C: 0.02-0.17, Hf: 0-1.55%, B: 0.004-0.030%, Zr: 0-0.09%, Y: 0-0.01%, Mn: 0-1.00%, Cu: 0-0.50%, Si: 0-0.55%, remainder Ni. For example, the nickel based superalloy may be selected from Rene® 77, Rene® 80, Rene® 108, Rene® 125, Rene® 142 or other nickel based alloy.

The cobalt based superalloy may be selected from cobalt alloys having, for example, an approximate composition in weight percent containing Ni: 6.0-22.0%, Fe: 0-3.0%, Cr: 20.0-23.5%, Ti: 0-0.20%, Ta: 0-3.50%, W: 7.00-15.00%, C: 0.10-0.60, Zr: 0-0.50%, Mn: 0-1.50%, Si: 0-0.50%, remainder Co. The cobalt based superalloy may be selected from the group MAR-M-509 (MM509), L605, X40 and other cobalt based alloys.

Other features and advantages of the present invention will be apparent from the following more detailed description of a preferred embodiment, taken in conjunction with the accompanying drawings, which illustrate by way of example, the principles of the invention.

DETAILED DESCRIPTION OF THE INVENTION

Disclosed herein is a wire damper and a method of forming a wire damper having high strength and improved wear characteristics.

Figure 1:
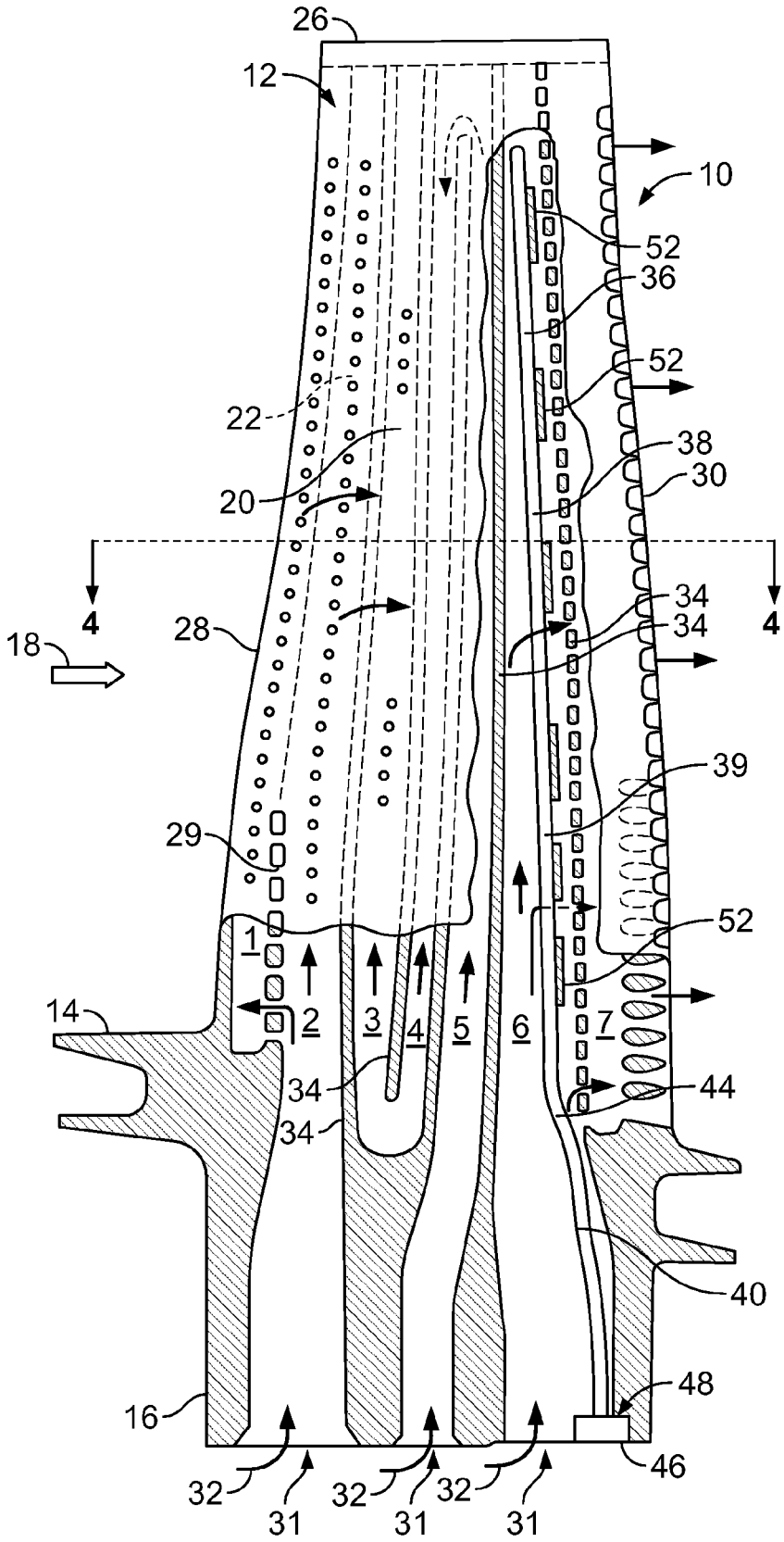
FIG. 1 is a partial sectional, elevational view of an exemplary gas turbine engine turbine rotor blade having an internal damper therein.

Referring now to FIG. 1, there is shown an exemplary turbine rotor blade 10 for use in a high or low pressure turbine of a gas turbine engine. The blade includes a hollow airfoil 12, a radially inner platform 14, and a supporting dovetail 16 formed in a unitary or integrally cast assembly. The dovetail 16 includes inlets 31.

During operation, the blade 10 is suitably supported in a turbine rotor disk (not shown) by the dovetail 16 mounted in a complementary dovetail slot in the perimeter thereof. Combustion gases 18 are generated in a combustor (not shown) and flow over the airfoil 12 in the direction indicated by the arrow, which extracts energy therefrom for rotating the supporting rotor disk.

The airfoil 12 includes a generally concave pressure side 20 and a circumferentially opposite, generally convex suction side 22 extending in radial or longitudinal span between the platform 14 and a radially outer tip 26. The pressure side 20 and the suction side 22 also extend in axial chord between opposite leading edge 28 and trailing edge 30, over the full span of the airfoil between the opposite inner and outer ends.

As further shown in FIG. 1, the airfoil 12 includes a plurality of longitudinal cooling flow channels 1-7 separated chordally by corresponding longitudinal partitions 34 which transversely bridge and integrally join together the opposite pressure and suction sidewalls 20, 22. The partitions 34 are integrally cast with the airfoil and extend fully between the opposite pressure or concave side 20 and the suction or convex side 22 along substantially the full longitudinal and radial span of the airfoil 12. The seven cooling channels 1-7 are arranged in three distinct portions for differently cooling the different portions of the airfoil 12 from leading edge 28 to trailing edge 30 and from dovetail 16 to tip 26.

In exemplary blade 10, the first channel 1 is disposed immediately behind the leading edge 28 and receives coolant 32 from the second channel 2 disposed immediately aft therefrom through impingement cooling holes 29. The second channel 2 has a dedicated inlet 31 extending through the platform 14 and dovetail 16. The middle three channels 3, 4, 5 are arranged in a three-pass serpentine circuit with the airfoil fifth channel 5 including a dedicated inlet. The coolant 32 flows radially outwardly through the fifth channel 5 to the airfoil tip 26 where it is redirected radially inwardly through the fourth channel 4 and flows downwardly to the platform 14 where again it is redirected upwardly into the third channel 3, which terminates at the blade tip 26.

The sixth and seventh channels 6, 7 are specifically configured at the aft end of the airfoil 12 to cool the thin trailing edge 30 thereof. The sixth flow channel 6 extends longitudinally inwardly through the platform 14 and dovetail 16 to inlet 31. The coolant 32 is channeled radially outwardly through the sixth channel 6 and then aft through a row of impingement cooling holes 33 found in the partition separating the sixth and seventh 6, 7 channels for impingement cooling the inner surface of the seventh channel 7.

The turbine blade 10 is modified for specifically introducing a wire or stick damper 36 specifically configured for effectively damping certain vibratory modes of operation associated with the relatively long blade 10 illustrated in FIG. 1. Since the damper 36 is a discrete component, it must be suitably mounted inside the blade 10, and increases the centrifugal loads carried thereby during operation. The damper 36 is therefore specifically introduced for maximizing damping effectiveness while minimizing adverse effects in the blade 10 due to its additional volume and weight.

The damper 36 may be introduced into any suitable flow channel within the blade 10 where the cooling design permits, and wherein it may have maximum damping effectiveness while minimizing adverse affect. For example, the damper 36 is preferably introduced within the sixth flow channel 6 as shown in FIG. 1.

The damper 36 cooperates with the partition for frictionally damping vibratory motion thereof during operation due to the various excitation forces experienced. The damper 36 includes a rod or wire 38 and a base or mounting block 46. The damper 36 extends in length from the base of the dovetail 16 to just below the airfoil tip 26.

The damper 36 is configured to conform with the shape of the channel in which it is mounted with slight radial inclination or lean so that centrifugal loads on the damper load the damper in friction against corresponding portions or lands of the airfoil for effecting internal friction damping during operation. The wire 38 is in contact with the catch ribs 52 as shown in FIG. 1. The catch ribs 52 are integrally cast into both the concave 20 and convex walls 22 and provide extra material on the walls to prevent wear-through. The block 46 is received in a complementary notched seat 48 in the dovetail 16. The block 46 is secured in seat 48 by a plate (not shown), which may be tack welded or otherwise attached to the dovetail 16. In an alternative design, the block 46 may be attached directly to the dovetail 16 by brazing or tack welding.

The damper 36 is typically nonlinear and curves or bends to match the three dimensional configuration of the channel in which the damper 36 is mounted. The curved configuration of the damper 36 includes an exemplary bend 44 that divides the wire 38 into an upper wire section 39 and a lower wire section 40 and additionally introduces bending stresses typically in the damper lower wire section 40. The damper upper wire section 39 is generally straight radially outwardly above the platform 14, but may also take a curved shape to match the twist of the airfoil 12.

The wire 38 has a substantially circular cross section, but may also take an oval, trapezoidal, rectangular or other shape optimized to match the internal cavity shape of the airfoil to provide maximum damping. The damper 36 may be formed with the bend 44, or with both the bend 44 and a curve or twist to match the twist of the airfoil 12 prior to insertion into the airfoil 12. In alternative embodiments of the invention, the damper 36 includes no bend and the wire 38 is substantially straight for its full length.

Figure 2:
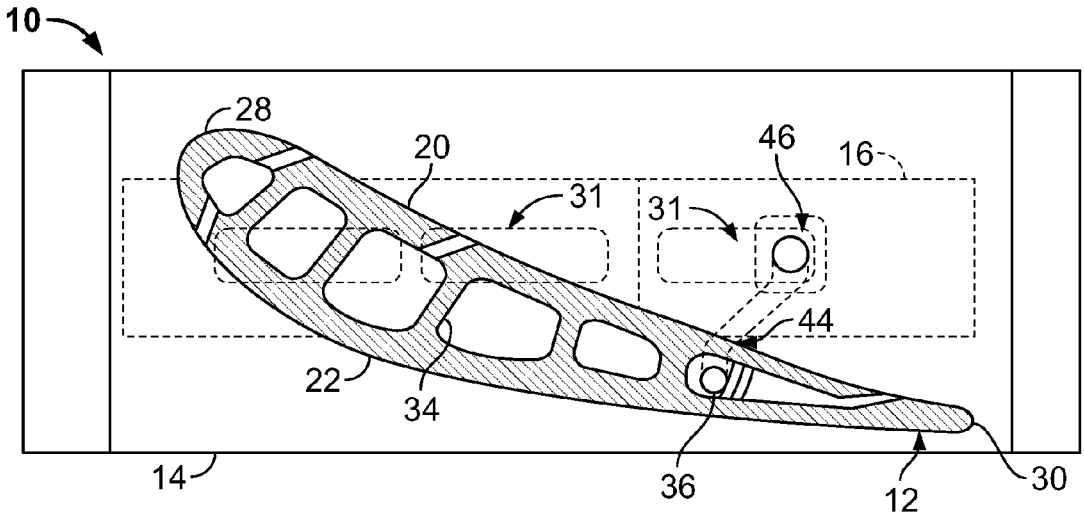
FIG. 2 is a radial sectional view of the blade illustrated in FIG. 1 taken along line 4-4.

FIG. 2 illustrates a radial cross section of the blade 10 taken along line 4-4 illustrated in FIG. 1. As can be seen in FIG. 2, the airfoil 12 is twisted above the platform 14 relative to the axial orientation of the supporting dovetail base 16. Accordingly, the flow channels 1-7 have a corresponding bend 44 or curvature through the blade 10, which is matched by introducing a bend 44 in the damper wire 36. In this way, the damper 36 may be conveniently installed in a blade 10 by being inserted through existing dovetail inlet 31.

Figure 3A:
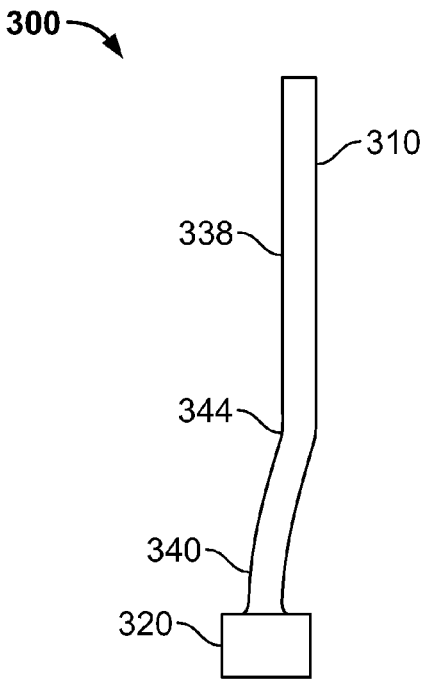
FIG. 3A illustrates an exemplary embodiment of a wire damper according to the invention.

FIG. 3A illustrates an exemplary embodiment of a wire damper 300 according to the invention. In this embodiment, the damper 300 includes a wire section 310 and a base section 320. The wire section 310 includes a bend 344 that divides the wire section 310 into an upper section 338 and a lower section 340. The wire section 310 is curved so as to match the curve on an internal channel on a blade into which the wire damper 300 is to be inserted.

The wire section 310 and the base section 320 may be formed of substantially the same material and referred to as a monolithic damper. For example, the damper 300 may be formed of an equiaxed nickel-based superalloy such as RENE® 77, RENE® 80, RENE® 108, RENE® 125, RENE® 142 or other nickel based alloy, or a cobalt-based superalloy such as MM-509, L605, X40 or other cobalt based alloy. In a preferred embodiment, the damper 300 may be formed of RENE® 80. Alternatively, the wire section 310 and the base section 320 may be formed of different materials and referred to as a bi-metallic damper. For example, the wire section 310 and the base section 320 may be formed of any combination of nickel-based and cobalt-based superalloys, including those specific alloys mentioned for the monolithic damper.

The wire section 310 may have a length of between about 2 inches and about 5 inches, and preferably with a length of between 3.5 inches and about 5 inches, and most preferably with a length of between about 4.75 inches and about 5 inches. Furthermore, the wire section 310 may have a substantially circular cross section. In a preferred embodiment, the wire section 310 may have a substantially circular cross section with a diameter of between about 0.020 inches and about 0.150 inches, and more preferably between about 0.035 inches and about 0.100 inches, and most preferably between about 0.060 inches and about 0.080 inches.

Figure 3B:
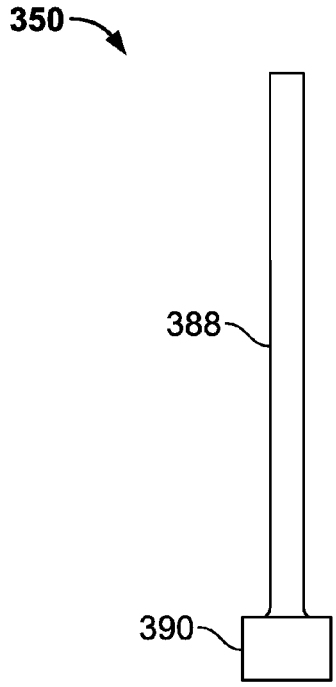
FIG. 3B illustrates another exemplary embodiment of a wire damper according to the invention.

FIG. 3B illustrates an exemplary embodiment of a wire damper 350 according to the invention. The wire damper 350 includes a wire section 388 and a base section 390. In this embodiment, the wire section 388 is substantially straight. As in the first exemplary embodiment, the wire damper 350 may be monolithic or bi-metallic. Furthermore, the wire damper 350 may be formed of any material as discussed in the first exemplary embodiment.

The metal injection molding (MIM) method of the present invention includes forming a powder mixture by mixing a metal powder and a temporary thermoplastic binder. Additional additives including lubricants and surfactants may be used, but should be limited so as not to affect the final metal composition. The metal powder and the binder are preferably mixed at a mixing temperature above the thermoplastic temperature of the thermoplastic binder. The powder mixture is then supplied to a powder injection system where it may be heated to a temperature above the thermoplastic temperature of the thermoplastic binder and injected into component dies to form a green damper. The component dies may be provided with preform inserts as discussed below. The injected powder mixture is then allowed to cool, if heated, and the formed green damper is removed from the dies for further processing.

Figure 4:
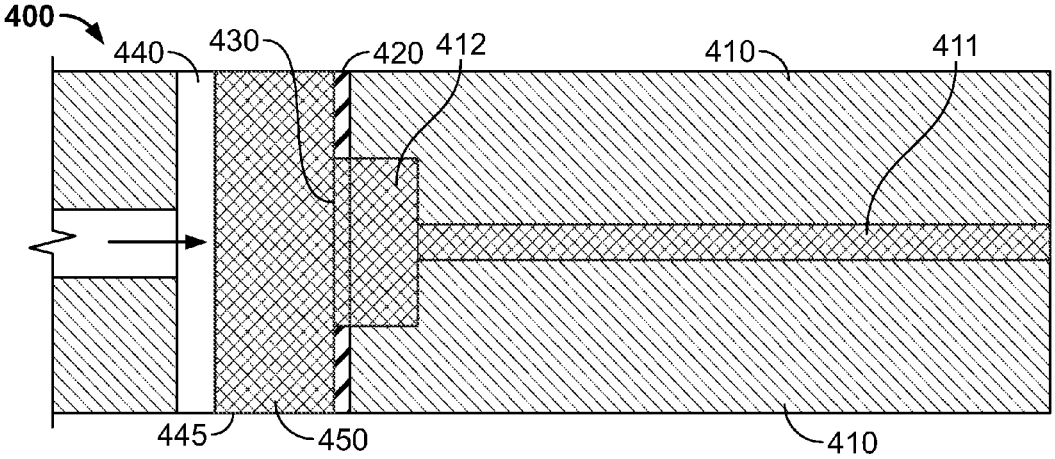
FIG. 4 illustrates an exemplary embodiment of an apparatus for forming a wire damper according to the invention.

An exemplary method of forming a green monolithic wire damper using an exemplary MIM apparatus 400 is shown in FIG. 4. As can be seen in FIG. 4, the MIM apparatus 400 includes component dies 410, a MIM apparatus forming die interface 420, an injection molding nozzle 430, a ram 440, and a powder injection system 445. The powder injection system 445 contains a powder mixture 450. The dies 410 include a wire cavity 411 and a base cavity 412. In this exemplary embodiment, the dies 410 are shown having two components. Alternatively, the MIM apparatus 400 may include a die formed from a single component, or each die component may be formed of multiple components.

The MIM apparatus 400 is shown in FIG. 4 after a portion of the powder mixture 450 has been injected into the dies 410 through interface 420 and nozzle 430. Interface 420 and nozzle 430 have been configured to inject powder mixture 450 into both the wire cavity 411 and the base cavity 412.

The powder mixture 450 may be heated by heaters (not shown) proximate to or a part of the powder injection system 450. Alternatively, the powder mixture may be injected cold. After the powder mixture 450 has been injected into the dies 410, the dies 410 are separated from the die interface 420 and the injected powder mixture 450.

Figure 5:
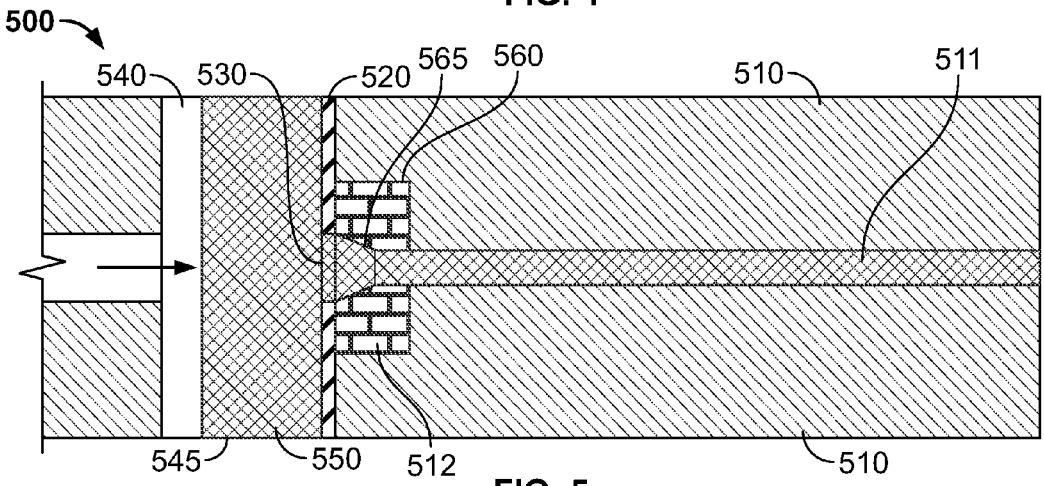
FIG. 5 illustrates another exemplary embodiment of an apparatus for forming a wire damper according to the invention.

An exemplary method of forming a bimetallic green wire damper using an exemplary MIM apparatus 500 is shown in FIG. 5. As can be seen in FIG. 5, the MIM apparatus 500 includes component dies 510, a MIM apparatus forming die interface 520, an injection molding nozzle 530, a ram 540, and a powder injection system 545. The powder injection system 545 contains a powder mixture 550. The dies 510 include a wire cavity 511 and a base cavity 512. In this exemplary embodiment, the dies 510 are shown having two components. Alternatively, the MIM apparatus 500 may include a die formed from a single component, or each die component may be formed of multiple components.

The MIM apparatus 500 is shown in FIG. 5 after a portion of the powder mixture 550 has been injected into the wire cavity 511 through interface 520 and nozzle 530. In this exemplary embodiment, the base cavity 512 has been prefilled with a preform base insert 560 having a different material composition than powder mixture 550. Interface 520 and nozzle 530 have been configured to inject powder mixture 550 into the wire cavity 511 through the insert 560. As can be seen in FIG. 5, the insert 560 includes a tapered passage 565 that assists in locking the injected powder mixture 550 to the insert 560. Alternatively, the preform insert 560 may be formed of the same composition as the powder mixture 550 to form a monolithic damper.

The preform may be formed by MIM, hot isostatic pressing, or other powder metallurgy method. The preform may be in a green, brown or fully dense state, and preferably is in a green state. Alternatively, the perform may be formed by fusion metallurgy, such as by casting and machining. Additionally, the preform may be formed of multiple preform components.

Figure 6:
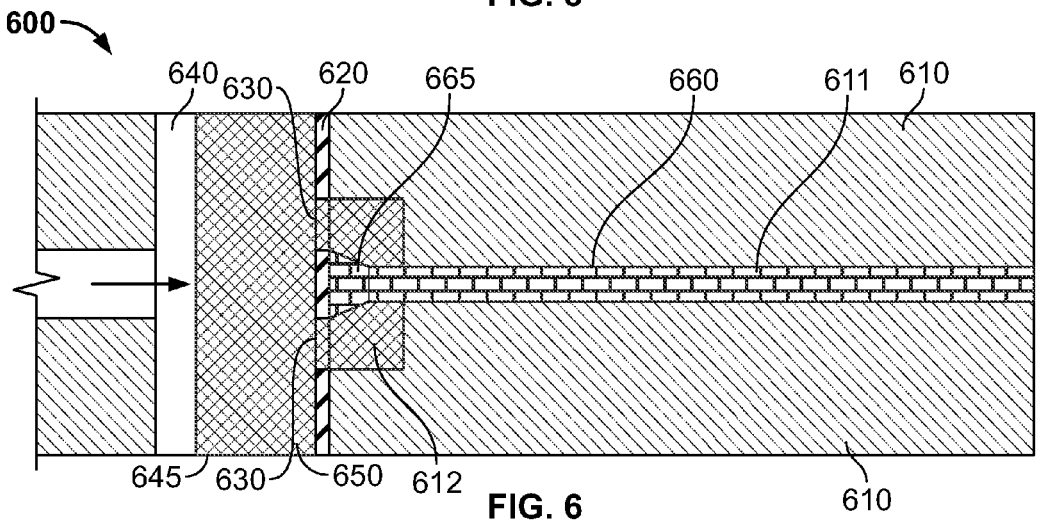
FIG. 6 illustrates a further exemplary embodiment of an apparatus for forming a wire damper according to the invention.

Another exemplary method of forming a green bimetallic wire damper using an exemplary MIM apparatus 600 is shown in FIG. 6. As can be seen in FIG. 6, the MIM apparatus 600 includes component dies 610, a MIM apparatus forming die interface 620, an injection molding nozzle 630, a ram 640, and a powder injection system 645. The power injection system 645 contains a powder mixture 650. The dies 610 include a wire cavity 611 and a base cavity 612. In this exemplary embodiment, the dies 610 are shown having two components. Alternatively, the MIM apparatus 600 may include a die formed from a single component, or each die component may be formed of multiple components.

The MIM apparatus 600 is shown in FIG. 6 after a portion of the powder mixture 650 has been injected into the base cavity 612 through interface 620 and nozzle 630. In this exemplary embodiment, the wire cavity 611 has been prefilled with a preform wire insert 660 having a different material composition than powder mixture 650. Interface 620 and nozzle 630 have been configured to inject powder mixture 650 into the base cavity 612 around a portion of the wire insert 660. As can be seen in FIG. 6, the insert 660 includes a tapered portion 665 that assists in locking the injected powder mixture 650 to the insert 660. Alternatively, the preform wire insert 660 may be formed of the same composition as the powder mixture 650 to form a monolithic damper.

In yet another exemplary method of forming a green bimetallic wire damper, a combination of the exemplary methods described above is used to first form either the base or wire section through an interface and nozzle configured to inject the powder without a preform, and then reconfiguring the interface and nozzle to injecting a second powder mixture to form the corresponding wire or base section, respectively, thereby forming a green bimetallic wire damper.

The green damper formed by any of the exemplary MIM methods described above is then transferred to a solvent bath that removes a large amount of the binder, but leaves enough binder to keep the pre-sintered brown form together for sintering. Sintering removes the remainder of the binder and consolidates the powder to form a high density, near net shape damper. Sintering also metallurgically bonds the injected powder to any preform insert that may have been used. The sintering is preferably performed in a vacuum oven or vacuum sintering furnace. Alternatively, the sintering may be carried out in an inert atmosphere such as argon, or a reducing atmosphere such as hydrogen. As the temperature of the brown damper is increased, the remaining binder is evaporated and removed, leaving no trace chemicals. The sintering is preferably solid-state sintering and thus below the melting point of the metal powder. The sintering is carried out at a temperature of between about 1,850° F. and 2,200° F., and preferably carried out at a temperature of between about 2,100° F. and about 2,200° F. The sintering preferably sinters the metal powder to a relative density of greater than 90%, and preferably to a density of greater than 95%, and even more preferably to a density of greater than 98.5%.

The sintered damper is preferably optionally further densified by a heat treatment process such as hot isostatic pressing. Hot isostatic pressing at a temperature of greater than about 2150° F. for nickel-base or cobalt-base superalloys, at a pressure of from about 15,000 to about 25,000 pounds per square inch, and for a time of about 1 to about 5 hours to increase the relative density of the damper to greater than about 99.8%, and even more preferably to a density of approximately 100%. The damper may be strengthened by further processing including hot and/or cold working.

The metal powder may be a pre-alloyed metal powder of substantially uniform composition. Alternatively, the metal powder may be of mixed compositions, but selected so that the powder net composition is the damper composition. Preferably, the pre-alloyed approach is used to assure that the damper is macroscopically and microscopically uniform throughout each section of the damper.

The metal powders are generally spherical with a diameter of between about 1 micrometer to about 300 micrometers, and preferably with a diameter of between about 2.5 micrometers to about 150 micrometers. Preferably, the powder is formed of a distribution of powder sizes to enhance powder flow characteristics during the injection process. Proper distribution of particle sizes between large, medium, and small ensures that gaps and vacancies in the green state are filled as best as possible prior to sintering, thus providing greatest density after sintering.

A preferred pre-alloyed metal powder composition for a nickel-base superalloy damper is Rene® 80, having a nominal composition of about 9.5% Co, about 14.0% Cr, about 3.0% Al, about 5.0% Ti, about 4.0% W, about 4.0% Mo, about 0.17% C, about 0.015% B, about 0.03% Zr, and remainder Ni. A preferred prealloyed metal powder composition for a cobalt-base superalloy damper is MAR-M-509, having a nominal composition of about 10.0% Ni, 23.5% Cr, 0.20% Ti, about 3.50% Ta, about 7.0% W, about 0.6% C, about 0.50% Zr, and remainder Co.

The thermoplastic binder may be any operational thermoplastic binder suitable for sintering operations, preferably an organic or hydrocarbon thermoplastic binder. Examples include polyethylene, polypropylene, wax such as paraffin wax or carnuba wax, and polystyrene. A sufficient amount of the thermoplastic binder is used to render the mixture cohesive and pliable at temperatures above the thermoplastic temperature of the thermoplastic binder. The mixing of the powders and the binder is preferably performed at a mixing temperature that is above the thermoplastic temperature of the thermoplastic binder, which is typically 200° F. or greater but depends upon the specific thermoplastic binder material that is used. The thermoplastic binder material becomes flowable or "molten" at and above the thermoplastic temperature, which aids in mixing. The mixing at this mixing temperature achieves a mixture that is flowable and injection moldable at or above the thermoplastic temperature, but which is relatively inflexible and hard below the thermoplastic temperature.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A damper for a turbine blade, comprising:
a wire section;
a mounting block at a proximal end of the wire section;
wherein at least one of the wire section and mounting block are formed from an equiaxed nickel-based alloy,
a cobalt-based alloy or a combination thereof; and
the wire section and the mounting block are internal to the turbine blade.

2. The damper of claim 1, wherein the equiaxed alloys include a nickel based superalloy, a cobalt based superalloy, or a combination thereof.

3. The damper of claim 2, wherein the equiaxed nickel based superalloys include powders comprising approximately Co: 3.1-21.6%, Fe: 0-0.5%, Cr: 4.2-19.5%, Al: 1.4-7.80%, Ti: 0-5.00%, Ta: 0-7.20%, Nb 0-3.50%, W: 0-9.50%, Re 0-5.40%, Mo: 0-10.00%, C: 0.02-0.17%, Hf: 0-1.55%, B: 0.004-0.030%, Zr: 0-0.09%, Y: 0-0.01%, Mn: 0-1.00%, Cu: 0-0.50%, Si: 0-0.55%, remainder Ni.

4. The damper of claim 3, wherein the nickel based superalloy powders are selected from a group consisting of:
Co: 9.5%, Cr: 14.0%, Al: 3.00%, Ti: 5.00%, W: 4.00%, Mo: 4.00%, C: 0.17%, B: 0.015%, Zr: 0.03% remainder Ni;
Co: 15.0%, Fe: 0.5%, Cr: 14.6%, Al: 4.30%, Ti: 3.35%, Mo: 4.20%, C: 0.07%, B: 0.015%, Zr: 0.04%, remainder Ni;
Co: 9.5%, Cr: 8.4%, Al: 5.50%, Ti: 0.80%, W: 9.50%, Mo: 0.50%, C: 0.02-0.09%, B: 0.020%, remainder Ni;
Co: 10.0%, Cr: 8.9%, Al: 4.80%, Ti: 2.50%, W: 7.00%, Mo: 2.00%, C: 0.11, B: 0.020%, Zr: 0.10%, remainder Ni; and
Co: 12.0%, Cr: 6.8%, Al: 6.15%, W: 4.90%, Mo: 1.50%, C: 0.12%, B: 0.020%, remainder Ni.

5. The damper of claim 2, wherein the equiaxed cobalt based include powders comprising approximately Ni: 6.0-22.0%, Fe: 0-3.0%, Cr: 20.0-23.5%, Ti: 0-0.20%, Ta: 0-3.50%, W: 7.00-15.00%, C: 0.10-0.60, Zr: 0-0.50%, Mn: 0-1.50%, Si: 0-0.50%, remainder Co.

6. The damper of claim 5, wherein cobalt based superalloy powders are selected from a group consisting of:
Ni: 10.0%, Fe: 3.0%, Cr: 20.0%, W: 15.00%, C: 0.10%, Mn: 1.50%, remainder Co;
Ni: 10.0%, Cr: 24.0%, Ti: 0.20%, Ta: 3.50%, W: 7.00%, C: 0.60%, Zr: 0.50%, remainder Co; and
Ni: 10.0%, Fe: 1.5%, Cr: 22.0%, W: 7.50%, C: 0.50%, Mn: 0.50%, Si: 0.50%, remainder Co.

7. The damper of claim 1, wherein the wire section and the mounting block are formed of powders having substantially the same composition.

8. The damper of claim 1, wherein the wire section and the mounting block are formed of powders of substantially dissimilar compositions.

9. The damper of claim 1, wherein the wire section is formed of a cobalt based superalloy powder.

10. The damper of claim 1, wherein the mounting block is formed of a nickel based superalloy powder.

11. The damper of claim 1 wherein the wire section of the damper further includes a bend, the bend formed prior to insertion into the turbine blade.

12. The damper of claim 1 wherein the bend divides the wire section into an upper section and a lower section.

13. A green wire damper for a turbine blade, comprising:
a wire insert comprising a first powder mixture; and
a base insert having a second powder mixture;
wherein each powder mixture includes a metal powder and a temporary binder.

14. The green wire damper of claim 13 wherein the metal powders in each powder mixture includes a distribution of powder sizes, the powder sizes being of spherical shape with a diameter of between about 1 micrometer to about 300 micrometers.

15. The green wire damper of claim 13 wherein the temporary binder is a thermoplastic binder selected from the group consisting of organic and hydrocarbon binders.

16. The green wire damper of claim 13 wherein the temporary thermoplastic binder selected from the group consisting of organic and hydrocarbon binders includes polyethylene, polypropylene, polystyrene, wax, paraffin wax, carnuba wax, and combinations thereof.

17. The green wire damper of claim 13 wherein the damper is bimetallic, the first powder mixture having a different material composition than the second composition.

18. The green wire damper of claim 13 wherein at least one of the first powder mixture and second powder mixture is a nickel-base superalloy having a nominal composition of Co: 9.5%, Cr: 14.0%, Al: 3.0%, Ti: 5.0%, W: 4.0%, Mo: 4.0%, C: 0.17%, B: 0.015%, Zr: 0.03%, and the remainder Ni.

19. The green wire damper of claim 13 wherein at least one of the first powder mixture and second powder mixture is a cobalt-base superalloy having a nominal composition of Ni: 10.0%, Cr: 23.5%, Ti: 0.20%, Ta: 3.50%, W: 7.00%, C: 0.60%, Zr: 0.50%, and the remainder Co.

* * * * *